US005365762A

United States Patent [19]

Thompson

[11] Patent Number: 5,365,762

[45] Date of Patent: Nov. 22, 1994

[54] SUCTION-TYPE SHOT PEENING MACHINE SENSOR

[75] Inventor: Robert A. Thompson, Quaker Street, N.Y.

[73] Assignee: General Electric Company, Schenectady, N.Y.

[21] Appl. No.: 162,923

[22] Filed: Dec. 8, 1993

Related U.S. Application Data

[63] Continuation of Ser. No. 42,174, Apr. 2, 1993, abandoned.

[51] Int. Cl.[5] ..... B24C 1/00

[52] U.S. Cl. ..... 72/53; 451/39

[58] Field of Search ..... 72/53; 51/319, 320

[56] References Cited

U.S. PATENT DOCUMENTS 4,614,100 9/1986 Green et al. .
4,848,123 7/1989 Thompson .
4,873,855 10/1989 Thompson .
5,166,885 11/1992 Thompson .
5,176,018 1/1993 Thompson .

*Primary Examiner*—David Jones
*Attorney, Agent, or Firm*—Paul R. Webb, II

[57] ABSTRACT

This invention relates to a sensor for monitoring the operation of a suction-type shot peening machine. Such structures of this type, generally, measure the vacuum in the gun mixing chamber of the suction-type shot peening machine. Changes in this sensor will be indicative of either gun surging or changes in shot delivery rate or velocity. Its output will, therefore, provide diagnostic information on the performance of the process.

10 Claims, 5 Drawing Sheets

SUCTION-TYPE SHOT PEENING MACHINE SENSOR

This application is a continuation of application Ser. No. 08/042,174, filed Apr. 2, 1993, now abandoned.

BACKGROUND OF THE INVENTION

Field of the Invention

This invention relates to a sensor for monitoring the operation of a suction-type shot peening machine. Such structures of this type, generally, measure the vacuum in the gun mixing chamber of the suction-type shot peening machine. Changes in this sensor will be indicative of either gun surging or changes in shot delivery rate or velocity. Its output will, therefore, provide diagnostic information on the performance of the process.

Description of the Related Art

To assure a consistent, controlled, high quality shot peening process the shot velocity and stream properties must remain constant and known at all times. This suggests the need for sensors to signal changes in the process.

A feature of suction-type shot peening machines, which varies from application to application, is the way that secondary air is emitted into the suction chamber of the suction-type shot peening gun. This and other parameters affect the chamber vacuum and have a profound affect on gun performance. In applications where shot must be lifted from the reservoir to the gun, this secondary air is emitted upstream of the shot feed point through an adjustable needle valve. This needle valve controls the high velocity air which entrains shot and draws it through the hose and up to the gun where the shot is entrained by the blast air, accelerated, and ejected from the gun.

In gravity-feed shot peen machines, shot falls from the higher reservoir to the gun. Air flow in the shot feed line serves little purpose in this case. In fact, this type of gun often is equipped with electronic shot flow controllers which are adversely affected by variations in shot feed hose vacuum. In these cases, the vacuum is often vented downstream of shot feed or in the gun chamber itself. Thus, near atmospheric pressure is maintained across the shot flow controller so the control will operate stably. In these vented cases, even though the vacuum is almost fully relieved, the vent volumetric flow is control]ed by the remaining partial vacuum, so, like the vacuum itself, vent flow is also an indicator of gun performance.

In either case, the principle is the same. Since the magnitude and change of the chamber condition is affected by things which also affect gun performance, there is a need to measure chamber condition. Therefore, a more advantageous system, then, will be presented if the sensor could measure the condition of the suction chamber.

It is apparent from the above that there exists a need in the art for a sensor which is capable of being used with a suction-type shot peening gun, and which at least equals the sensing characteristics of the sensors used in other types of shot peening guns, but which at the same time is capable of sensing the conditions within the gun chamber of the suction-type shot peening gun. It is a purpose of this invention to fulfill this and other needs in the art in a manner more apparent to the skilled artisan once given the following disclosure.

SUMMARY OF THE INVENTION

Generally speaking, this invention fulfills these needs by providing a suction-type shot peening machine sensor, comprising a suction-type shot peening gun having a suction chamber, and a pressure detection means operatively connected to said suction chamber for measuring a pressure in said suction chamber.

In certain preferred embodiments, the suction-type shot peening gun also includes a shot hopper, a shot peen flow sensor, a shot/air mixing chamber, a hose connected between the mixing chamber and the suction chamber, a pressure detector operatively connected to the mixing chamber, a pressure detector operatively connected to the suction chamber, a force detector operatively connected to the suction-type shot peening gun, and a microprocessor operatively connected to the various pressure detectors, the mass flow controller, and the force detector.

An another preferred embodiment, the pressure detector measures the pressure within the suction chamber to measure the magnitude and change of the vacuum within the suction chamber such that changes in this detector will be indicative of either gun surging or changes in shot delivery rate or velocity.

The preferred suction-type shot peening machine sensor, according to this invention, offers the following advantages: lightness in weight; ease of assembly and repair; excellent vacuum measuring characteristics; excellent machine diagnostic characteristics; good stability; good durability; good economy; and high strength for safety. In fact, in many of the preferred embodiments, these factors of excellent vacuum measuring characteristics and excellent diagnostic characteristics are optimized to an extent that is considerably higher than heretofore achieved in prior, known shot peening sensors.

BRIEF DESCRIPTION OF THE DRAWINGS

The above and other features of the present invention which will be more apparent as the description proceeds are best understood by considering the following detailed description in conjunction with the accompanying drawings wherein like character represent like parts throughout the several views and in which.

DETAILED DESCRIPTION OF THE INVENTION

Figure 1:
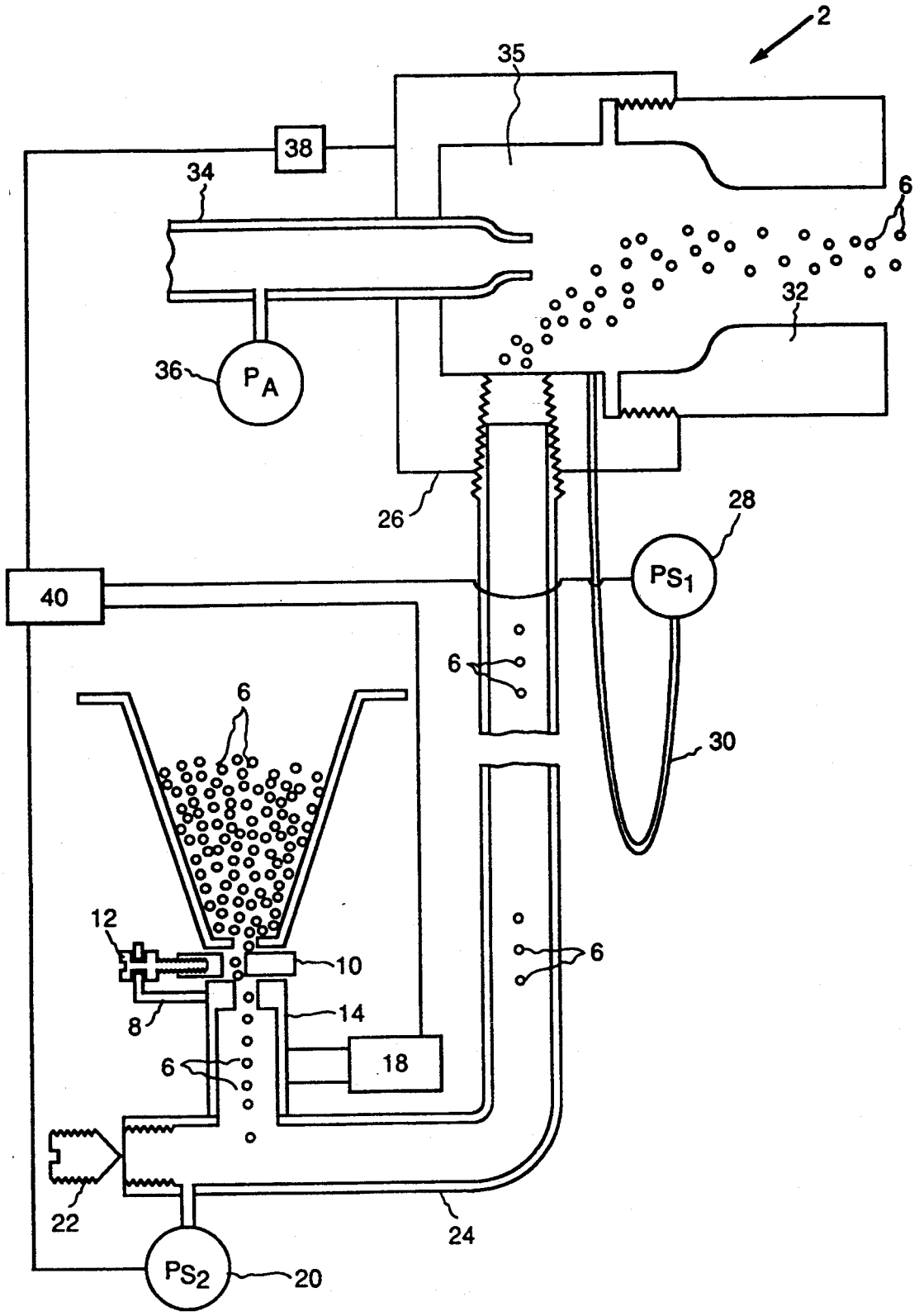
FIG. 1 is a schematic illustration of a suction-type shot peening machine sensor, according to the present invention.

With reference first to FIG. 1, there is illustrated suction-type shot peening machine sensing system 2. System 2 includes, in part, a conventional shot hopper 4, conventional shot 6, a conventional bracket 8, a conventional adjustable valve 10 having adjusting screw 12, conventional bracket 14, mass flow rate detector 18, pressure detector 20, secondary air controller 22, conventional hose 24, conventional gun body 26, pressure detector 28, pressure hose 30, conventional gun nozzle 32, conventional air blast inlet 34, suction chamber 35, air blast pressure detector 36, force detector 38 and conventional microprocessor 40.

Mass flow rate detector 18, preferably, is any suitable commercially available mass flow rate detector such as that set forth in commonly assigned U.S. Pat. No. 5,166,885 ('885), entitled "Non-Destructive Monitoring of Surfaces by 3-D Profilometry Using a Power Spectra" to R. A. Thompson. Pressure detectors 20, 28 and 36, preferably are any commercially available pressure detectors. Force detector 38, preferably, is the same force detector as set forth in the '885 patent.

During the operation of system 2, shot 6 is fed from hopper 4 through valve 12. While this is going on, air is entrained through air inlet blast 34 to gun 32 such that a vacuum is created in gun 32 at suction chamber 35. This vacuum, preferably, is measured by pressure detector 28. Also, the air blast pressure is measured by detector 36. As air blast inlet 34 is operated and a vacuum is created in chamber 35, the vacuum causes shot 6 to be drawn into gun 32 as shown in FIG. 1. The pressure near valve 10 is monitored by pressure detector 20. Finally, adjustment 22 is used, along with air blast inlet 34, to adjust the vacuum pressure in hose 24. Microprocessor 40, receives all of the information from flow rate detector 18, pressure detectors 20, 28 and 36 and force detector 38 and provides the operator with a conventional read-out of the information. Also, microprocessor 40 can be used as feedback mechanism to control the flow rate of shot 6 and/or the air pressure flowing through air blast inlet 34.

The importance of system 2 is that in suction-type shot peening systems, the shot feed line 24 is connected into the suction (mixing) chamber 35 such that when the nozzle of air blast inlet 34 is operating, an induced vacuum pulls air at a high velocity through the shot feed line 24. At the opposite end of the shot feed line 24, an adjustable air control valve and shot feed orifice control 22 control the combined flow rate of air and shot 6 through line 24.

Shot 6 entering the gun suction chamber 35 is entrained in the high velocity air jet from the nozzle of air blast inlet 34 and accelerated by air impingement out through the exit of gun 32. The resultant high velocity shot stream encounters the target (not shot) to be shot peened where it performs its function. There is an operating window based on the parameter settings where the suction machine will operate stably. If the machine parameters fall outside this window, the flow of shot 6 to the gun 32 will surge and the workpiece (not shown) will not see a uniform shot quantity or velocity distribution. Furthermore, as the components of the nozzle and shot feed line wear, their aerodynamic behavior will change, thus, changing the gun output characteristics. In either case, the vacuum in the suction chamber 35 is sensitive to the fault conditions.

To summarize, parameters which affect the vacuum in the suction chamber 35 are:

1. Air pressure supplied by the blast nozzle 34;
2. Shot mass flow rate as measured by sensor 18;
3. Air flow in the shot feed hose as measured by detector 20;
4. Shot feed hose wear, leakage, and routing;
5. Internal alignment of gun 32; and
6. Nozzle of gun 32 (wear and diameter).

Figure 2:
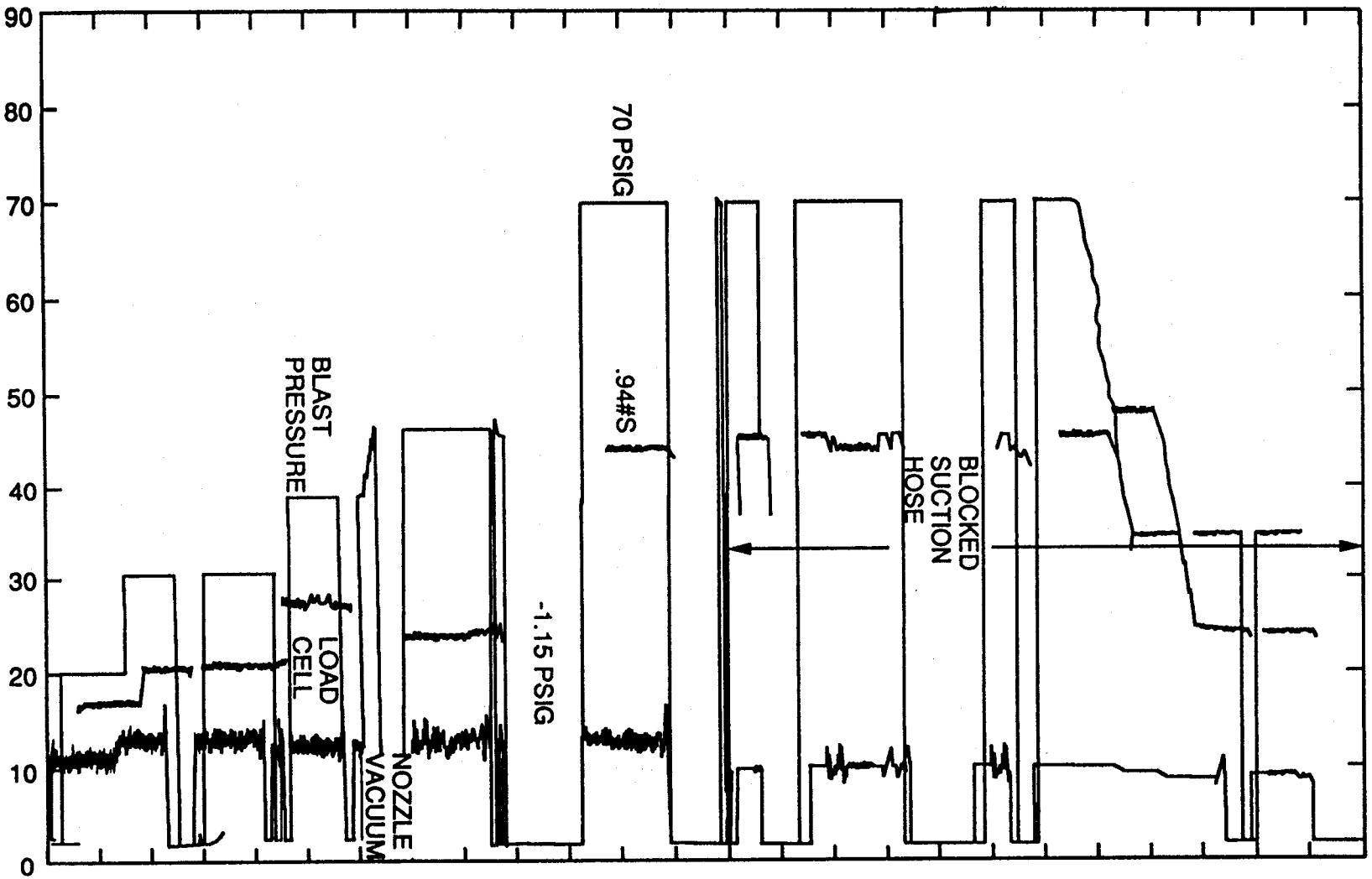
FIG. 2 is a graphical illustration of the relationship between the blast pressure and the nozzle chamber vacuum.

Of these six sources of chamber vacuum variations, the first four were measured and recorded on strip charts during tests run on a commercially available Vacublast Shot Peening machine. The results of these tests are illustrated in FIGS. 2–4.

During the testing of the present invention using the suction-type shot peening machine sensor system 2, three parameters were recorded on strip charts for several test conditions. They were, air pressure supplied to blast nozzle 34, gun reaction force measured by force detector 38, and the vacuum of suction chamber 35 as sensed by pressure detector 28. The pressure measurements were electrical signals which varied linearly with the measured variable and had the following calibrations:

Blast pressure = 1.0 psi/division
Reaction force = 0.02 pounds force/division
Chamber vacuum = −0.15 psig/division As a result of the tests using system 2, the following results were obtained:

1. The affect of blast air pressure.

The pressure of the air supplied to the blast nozzle 34 in FIG. 1 has a direct affect on shot velocity because the air pressure governs the air velocity in the gun nozzle where the air mixes with and accelerates the shot. FIG. 2 shows the relationship between the blast pressure and nozzle chamber vacuum. Clearly, as the blast pressure decreases, so does the chamber vacuum, the gun reaction force, and with it, the shot velocity. However, the vacuum change is nonlinear, being smaller at high blast pressures and growing larger at the lower pressures. The force change which is an indication of the stream momentum and, thus, shot velocity change is, on the other hand, linear with blast pressure. Reaction force as measured by force detector 38 is therefore a better indicator of shot velocity.

2. The affect of shot mass flow rate.

Figure 3A:
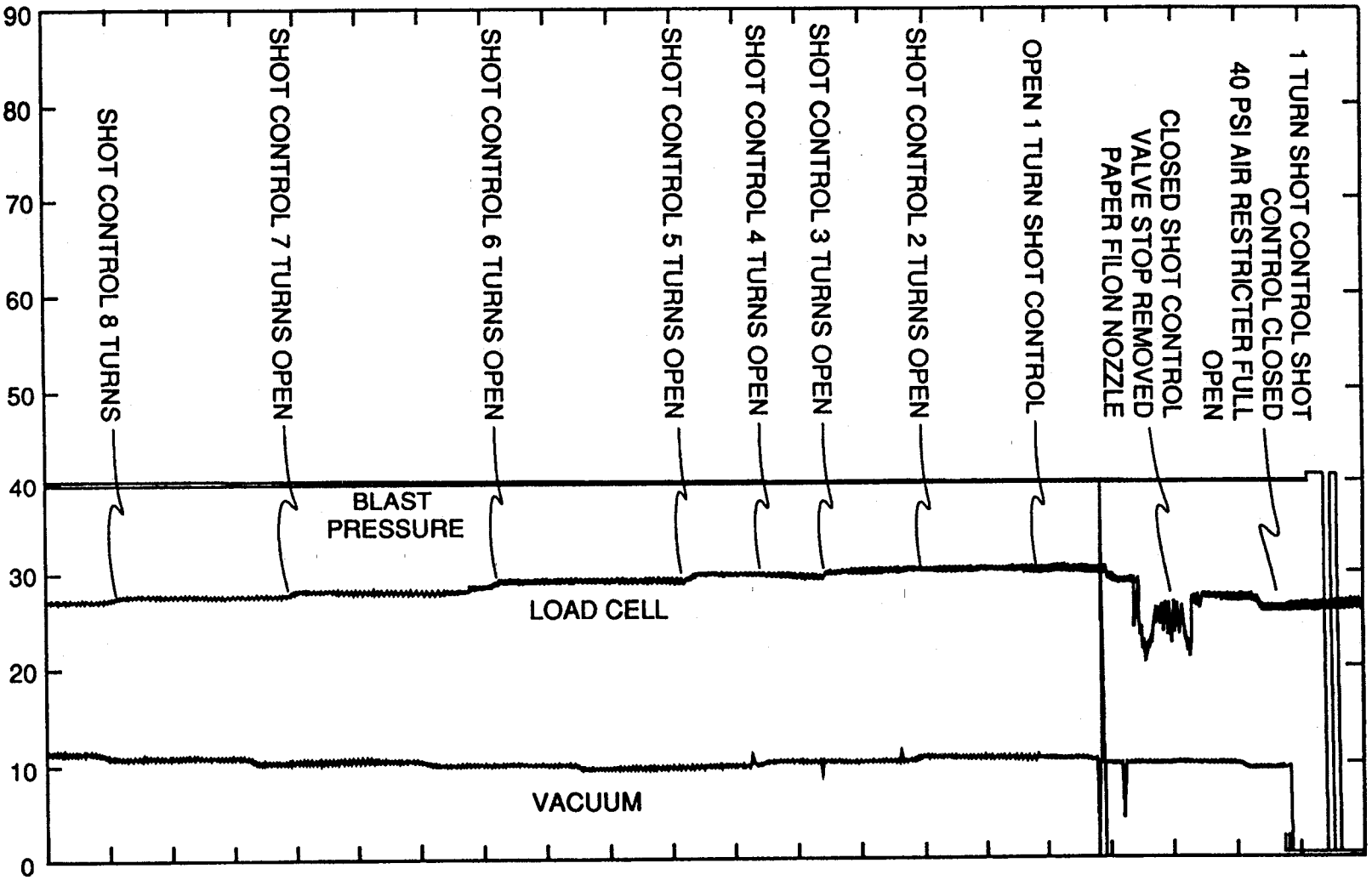
FIGS. 3*a* and 3*b* are graphical illustrations of the affect of chamber vacuum for various shot mass flow rates at two different blast pressures, 40 psi and 70 psi, respectively.
Figure 3B:
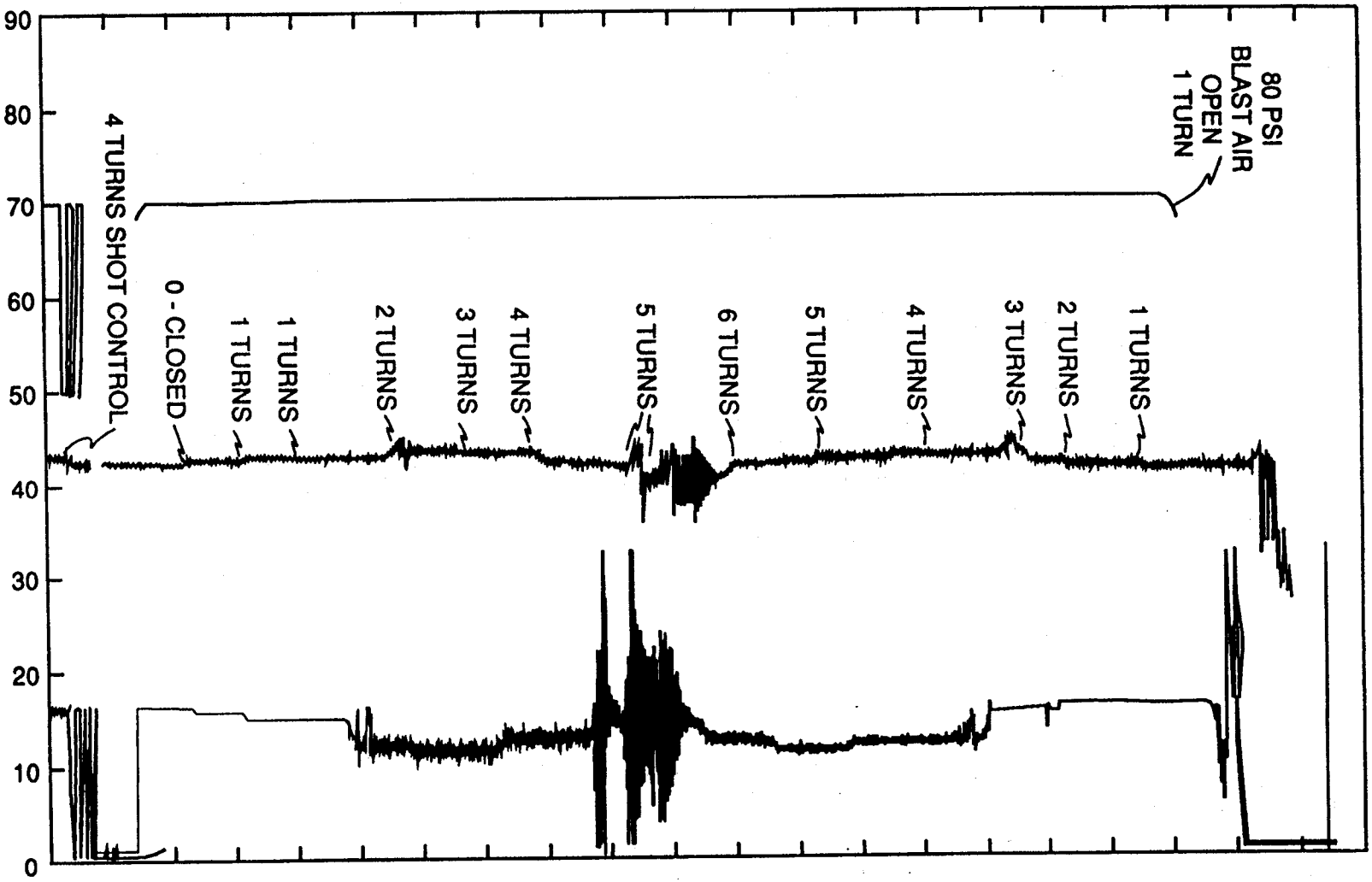
Figure 4:
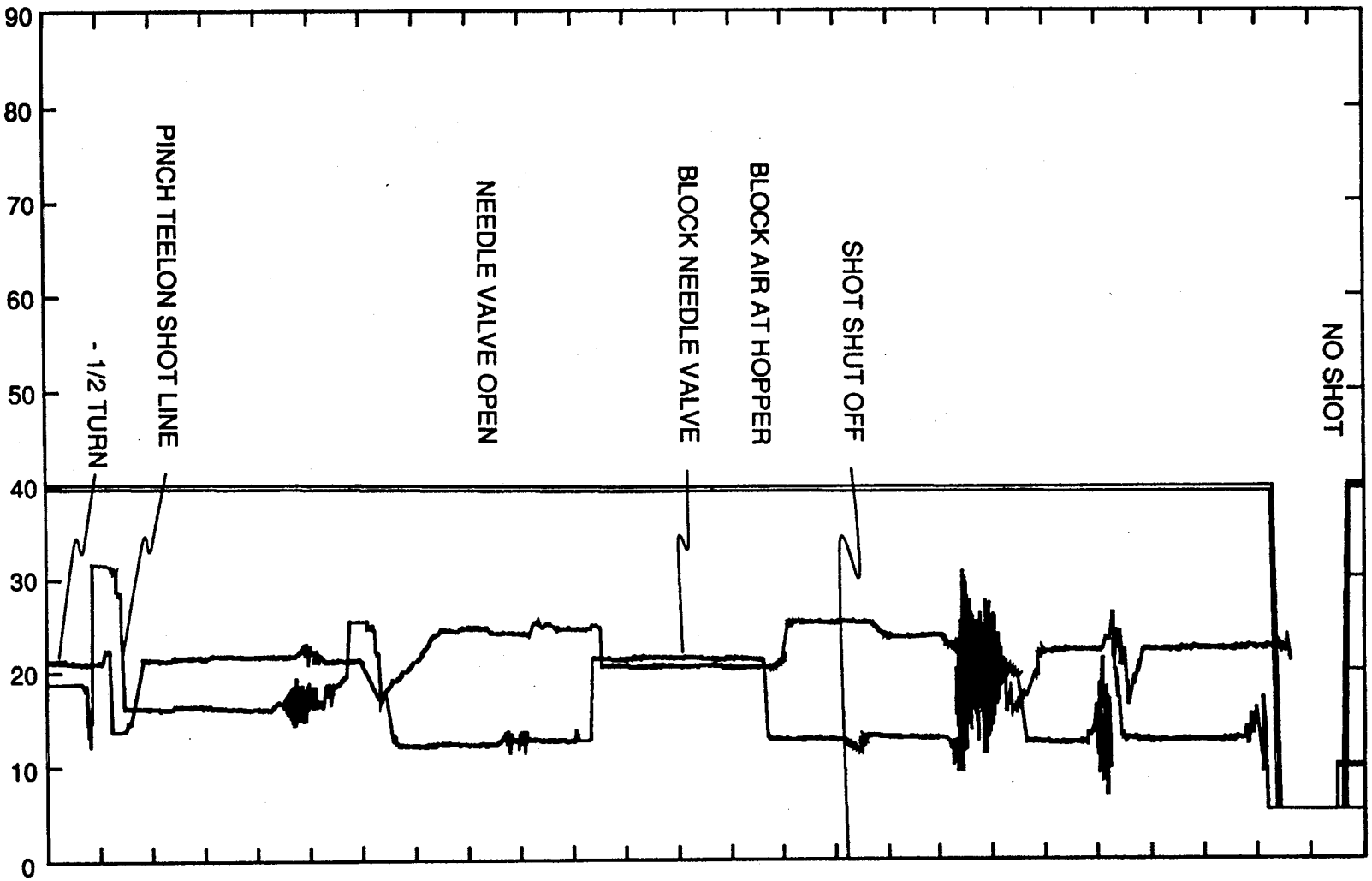
FIG. 4 is a graphical illustration which shows the reaction of the vacuum and force sensors to blocking the secondary air at the shot hopper, and with the needle valve opened and closed.

FIGS. 3*a* and 3*b* show the affect of chamber vacuum for various shot mass flow rates at two different blast pressures, 40 psi and 70 psi, respectively. FIGS. 3*a* and 3*b* show the complex two phase flow behavior that exists in a suction-type shot peening gun. FIGS. 3*a* and 3*b* underscore the need for a performance sensor for this type gun.

In particular, in FIG. 3*a*, while the blast pressure was held at 40 psi, the shot control orifice of valve 10 was opened in one turn steps increasing the shot mass flow rate from 0 lbs./min. between 1 and 2 turns to about 11 lbs/min. between 3 and 4 turns. Further adjustments of the shot control orifice if valve 10 in either direction from these limits only affected the secondary air pull through the system. From FIG. 3*a*, it can be seen that the vacuum first, as expected, decreased up to 4 turns of the shot control but then increased for further increased turns. As the shot control was further opened, the shot feed line started to plug with shot and, thus, block the flow of vacuum relieving secondary air. This affect became so pronounced that the system 2 began to oscillate, causing the shot flow to be a series of bursts, a common fault condition for suction-type machines, one which throws the process totally out of control.

FIG. 3*b* displays the same, but more pronounced behavior, with the vacuum reversing between 4 and 5 turns of the shot control valve 10 and violent oscillations at 6 turns. In short, FIGS. 3*a* and 3*b* illustrate the vacuum sensor's ability to respond to the complex interaction of secondary air in shot mass flow and to predict the onset of system instability.

3. Effect of shot feed hose condition

Finally, FIG. 4 shows the reaction of the vacuum and force sensors to blocking the secondary air at the shot hopper with adjuster 22, and with the needle valve 10 opened and closed. FIG. 4 also shows the affect of pinching the shot feed hose 24. Each action to block shot, secondary air, or both had a strong, unique predictable affect on the chamber vacuum.

In overview,the present invention has shown that a chamber vacuum is very sensitive to changes in the flow of air, both blast and secondary, and shot 6 to the gun 32. Since each of these parameters has a strong affect on the distribution and velocity of the shot stream, the vacuum sensor 28 is a proven, very sensitive measure of gun performance, especially in detecting flow instability. Application of the sensor would involve setting a window for vacuum during the peening operation and automatically shutting the machine down if the vacuum goes outside the window, indicating a fault condition. This applies both to steady state vacuum and oscillations indicating instability.

Once given the above disclosure, many other features, modification or improvements will become apparent to the skilled artisan. Such features, modifications or improvements are, therefore, considered to be a part of this invention, the scope of which is to be determined by the following claims.

What is claimed is:

1. A suction-type shot peening machine sensor, wherein said sensor is comprised of:

a suction-type shot peening gun having a suction chamber; and a pressure detection means operatively connected to said suction chamber for measuring a pressure in said suction chamber.

2. The sensor, as in claim 1, wherein said suction-type shot peening gun is further comprised of:

a shot means;

a shot hopper means;

a shot flow measurement and control means operatively connected to said hopper weans;

a tube means operatively connected to said hopper means;

a gun nozzle means operatively connected to said tube means which substantially surrounds said suction chamber; and an air blast inlet means operatively connected to said gun nozzle means for introducing air into said gun nozzle means.

3. The sensor, as in claim 2, wherein said shot peen flow control means is further comprised of:

a mass flow sensor.

4. The sensor, as in claim 2, wherein said tube means is further comprised of:

a pressure detector operatively connected to said tube means.

5. The sensor, as in claim 2, wherein said tube means is further comprised of:

an air pressure regulation means.

6. The sensor, as in claim 2, wherein said gun nozzle means is further comprised of:

a reaction force detector operatively connected to said gun nozzle means for detecting a reaction force as said shot and air exit said gun nozzle.

7. The sensor, as in claim 2, wherein said air blast inlet means is further comprised of:

a pressure detector operatively connected to said air blast inlet means for detecting a pressure of said air in said air blast inlet means.

8. The method for monitoring a suction-type shot peening machine using an apparatus comprising a suction-type shot peening machine having a shot hopper, a shot flow control means, a tube means, a gun nozzle means including a suction chamber, an air blast inlet means, and a pressure detection means operatively connected to said suction chamber, wherein said method is comprised of the steps:

operating said air blast inlet means to flow air into said gun nozzle means which creates a vacuum in said suction chamber and said tube means;

operating said shot peen flow control means such that shot are emitted from said holder, traverse said tube means and enter said gun nozzle means and said suction chamber;

measuring an actual pressure substantially within said suction chamber means;

comparing said actual pressure with a predetermined pressure; and adjusting, if necessary, said air blast inlet means and said shot flow control means.

9. The method, as in claim 8, wherein said method is further comprised of the steps of:

measuring an actual pressure in said tube means; and measuring an actual pressure in said air blast inlet means.

10. The method, as in claim 8, wherein said method is further comprised of the step of:

measuring a reaction force of said gun nozzle means as a mixture of shot and air exit said gun nozzle means.

* * * * *